United States Patent [19]

Zurcher et al.

[11] Patent Number: 4,720,774

[45] Date of Patent: Jan. 19, 1988

[54] EASILY ASSEMBLED, SMALL STORAGE VOLUME LAMP

[75] Inventors: Fredric Zurcher, St. Charles; Daniel A. Wierzbowski, LaGrange, both of Ill.

[73] Assignee: Vigon Lighting, Compton, Calif.

[21] Appl. No.: 843,211

[22] Filed: Mar. 24, 1986

[51] Int. Cl.[4] ..... F21V 1/12

[52] U.S. Cl. ..... 362/360; 362/352; 362/806

[58] Field of Search ..... 362/360, 352, 351, 355, 362/367, 806

[56] References Cited

U.S. PATENT DOCUMENTS

| | | | |
|---|---|---|---|
| 1,574,613 | 2/1926 | Firman | 362/355 |
| 4,277,822 | 7/1981 | Weber et al. | 362/360 |
| 4,467,405 | 8/1984 | Weber | 362/360 |

OTHER PUBLICATIONS

"Home Lighting & Accessories" p. 23 May 1986.

*Primary Examiner*—E. Rollins Cross

*Attorney, Agent, or Firm*—Wood, Dalton, Phillips, Mason & Rowe

[57] ABSTRACT

Packaging problems with decorative lamps are avoided through the use of a lamp capable of storge in a relatively small space while disassembled and yet capable of rapid assembly without the use of tools. The lamp includes a base in the form of a regular, truncated polyhedron having a plurality of faces, each adapted to receive a decorative glass panel. Threaded fasteners pass through holes in ends of the panels to be received in threaded bores in the base to secure the panels thereto and the base is provided with a central opening for releasably, threadably receiving an electrical socket.

10 Claims, 7 Drawing Figures

FIG. 5
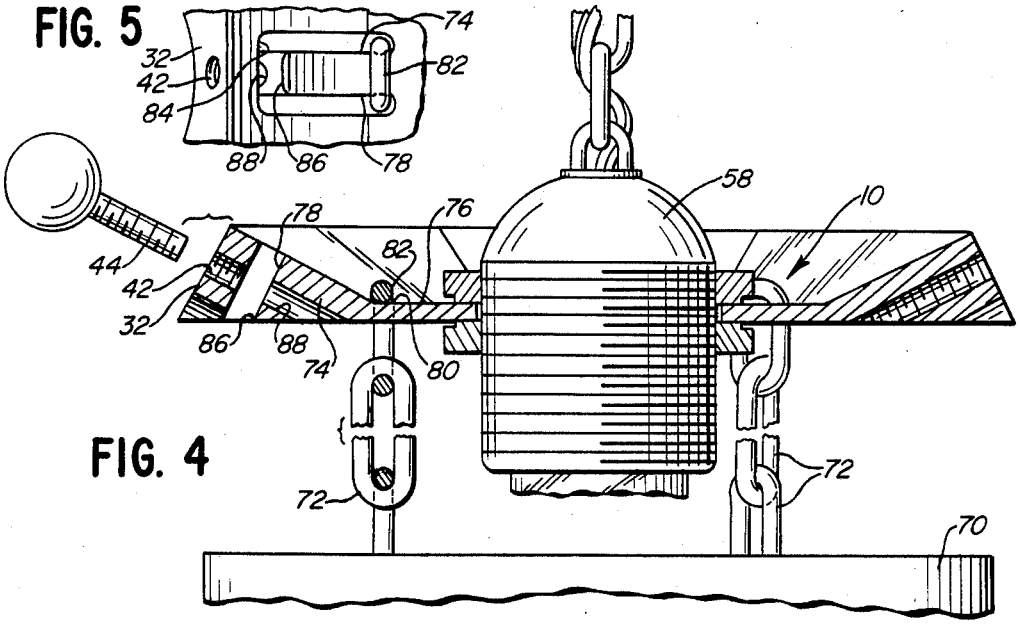
FIG. 4
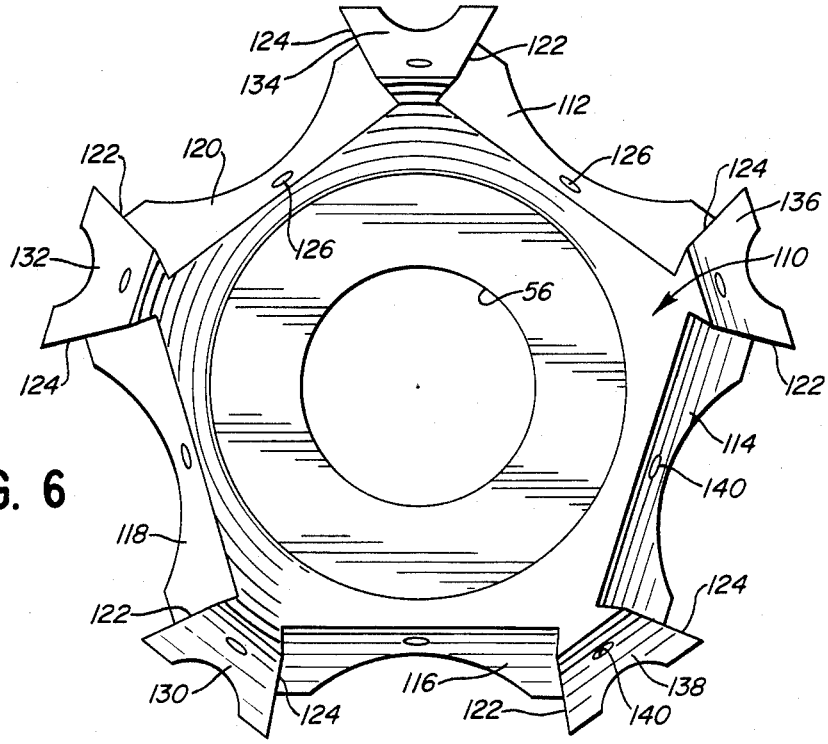
FIG. 6
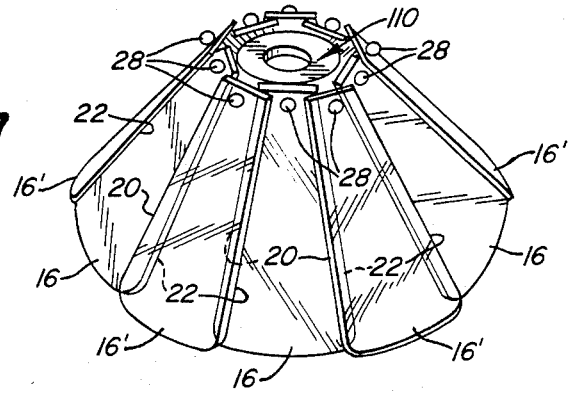
FIG. 7

EASILY ASSEMBLED, SMALL STORAGE VOLUME LAMP

FIELD OF THE INVENTION

This invention relates to lamps, and more specifically, to a lamp construction that can be stored or packaged in a relatively small volume while disassembled and which is easily assembled when assembly is desired.

BACKGROUND OF THE INVENTION

Lamp structures have traditionally occupied considerable volumes in contrast to their mass. Unquestionably this is due to the fact that a lamp is basically an aesthetic package for a light generator, typically an electric light bulb. In order to provide a decorative appearance to the packaging, a considerably greater volume than that required solely by the light bulb is defined by decorative panels, crystal, metal pieces and any number of other elements used for decoration leaving considerable void space.

This has generally required that the lamps be disposed in large cartons while being stored, shipped or merchandised. Because much of the volume of the carton as well as the lamp structure is a void, this method results in inefficient use of space, particularly at the merchandising level. If a merchandiser is to maintain a sufficient inventory of various lamp styles, considerable warehousing capacity or shelf space is required. Conversely, if the desired capacity is not available, then the number of differing lamp styles that can be kept in inventory by a given merchandiser is reduced. The lesser variety available at a given merchandiser, of course, hurts his ability to sell.

The present invention is directed to overcoming one or more of the above problems.

SUMMARY OF THE INVENTION

It is a principal object of the invention to provide a new and improved lamp assembly. More specifically, it is an object of the invention to provide a lamp capable of storage or packaging in a relatively small space while disassembled and yet which may be easily and rapidly assembled as, for example, subsequent to a sale to a purchaser.

An exemplary embodiment of the invention achieves this object in a structure including a base having a plurality of "n" slanted faces defining side faces of a truncated polyhedron. A fastener receiving bore is disposed in each of the faces and a plurality of "n" glass panels are provided. Each panel is adapted to bear decorative indicia and each has elongated opposed sides converging to define an end. A hole is disposed in each of the panels adjacent the end and a plurality of "n" fasteners are included. Each fastener has a decorative head and extends through the hole of an associated panel and into the bore of an associated one of the faces to mount the associated panel thereon so that the sides thereof are relatively close to the adjacent sides of adjacent panels with the heads of the fasteners being exposed for aesthetic purposes. Means are provided for mounting an electrical socket to the base.

As a consequence of this construction, the panels, when demounted from the base, can be stored in nested relation to minimize the space required for their packaging. The remaining components may be easily located in a relatively small package along with the nested panels. In a typical case, six of the lamps in disassembled condition may occupy the same volume as would be required for a packaged one of the lamps in the assembled condition.

According to one facet of the invention, the base is plate-like and the faces are equally angularly spaced around the periphery thereof. Each of the faces is bounded by sides extending outwardly of the face and adapted to abut and position corresponding sides of the associated panel.

In a modified embodiment of the invention, adjacent sides of each of two adjacent faces each terminate in a further face and each such further face is adapted to mount a further panel. Each of the further panels overlaps the junction of a pair of adjacent panels.

In a typical case, the bores and the fasteners are threaded. In addition to the decorative appearance of the head of the fasteners, such heads are made of sufficient size so as to be easily rotatable by a human hand to thereby provide a lamp structure which can be assembled without requiring tools.

Preferably, the base is a casting and there may be included a cushioning pad interposed between each of the panels and the associated face.

One embodiment of the invention contemplates that there be at least one hook shaped element formed in the base inwardly of the faces. The hook shaped element is adapted to receive a suspending device for suspending an object to hang from the lamp. For example, a planter can be suspended from the lamp.

In a highly preferred embodiment, the hook shaped element has a free end provided with a threaded bore aligned with the threaded bore in the adjacent face. As a consequence, one of the threaded fasteners may enter the free end and thereby capture the suspending device on the hook shaped element.

Other objects and advantages will become apparent from the following specification taken in connection with the accompanying drawings.

DESCRIPTION OF THE DRAWINGS

FIG. 4 is a sectional view of a modified embodiment of the lamp;

FIG. 5 is an enlarged, fragmentary view of a portion of the base of the embodiment shown in FIG. 4;

FIG. 6 is a plan view of a base of a further modified embodiment of the invention; and FIG. 7 is a perspective view of an assembled lamp made utilizing the base illustrated in FIG. 6.

DESCRIPTION OF THE PREFERRED EMBODIMENTS

Figure 1:
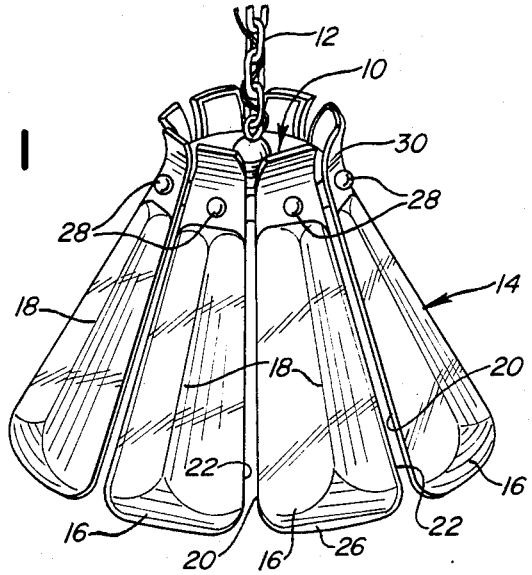
FIG. 1 is a perspective view of an assembled lamp made according to the invention.

An exemplary embodiment of a lamp made according to the invention is illustrated in FIG. 1 in the form of a lamp adapted to be suspended from a ceiling. However, it will be appreciated that the invention is not limited to suspended lamps but may be used with efficacy in ceiling mounted lamps and table lamps as well.

The lamp includes a base, generally designated 10, which, by means to be seen, includes an electrical socket. By any suitable means, a chain 12 is secured to the base 10 so that the lamp may be suspended. The lamp includes a shade, generally designated 14, defined by a plurality of individual glass panels 16. In the embodiment illustrated in FIG. 1, eight of the panels 16 are employed and each is provided with decorative indicia such as shown somewhat schematically at 18. The indicia may be in the form of lines, frosting, engraving, or any other aesthetic devices commonly used in the art.

Typically, the panel 16 will be planar and in the usual case will have opposed edges 20 and 22 which converge from bottom to top. The edges 20 and 22 are connected at a narrow end 24 (FIG. 3) at their upper extremity and by a relatively wide bottom end 26 which may be curved as shown in FIG. 1, or of any desired configuration. It will be noted that in a preferred embodiment, the edges 22 of one panel 16 are closely adjacent the edges 20 of the adjacent panel and vice versa. Usually the arrangement will be one of parallelism. However, particularly if non-planar panels are used, other arrangements may be used.

The panels 16 are secured to the base 10 by means of fasteners having enlarged, decorative heads 28. If desired, the upper ends 24 of each of the panels 16 may be covered by decorative metallic plates 30. Frequently, brass will be utilized for the purpose.

Figure 2:
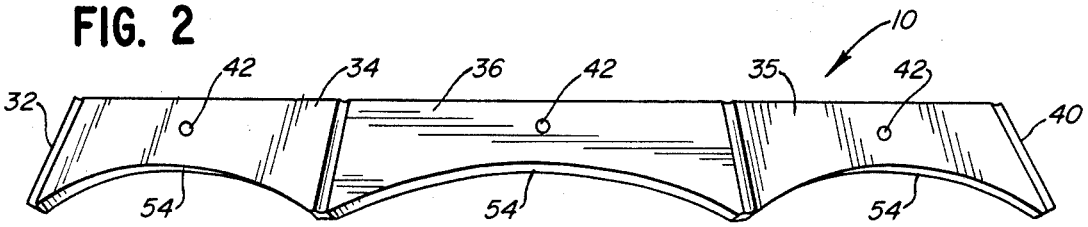
FIG. 2 is a side elevation of a base used in the lamp.
Figure 3:
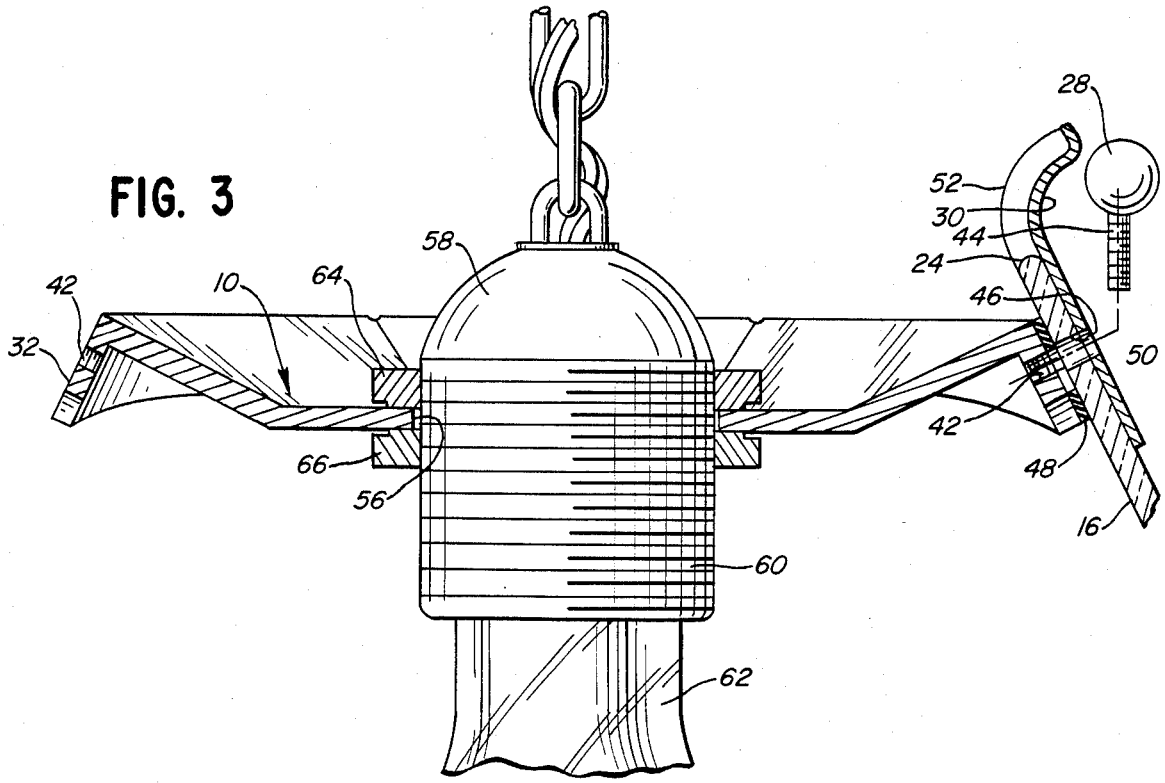
FIG. 3 is a sectional view of a portion of the lamp with parts broken away and other parts removed for clarity.

Turning now to FIGS. 2 and 3, the base 10 will be described in greater detail. As seen in FIG. 2, the same is relatively thin and has a plurality of faces corresponding to the number of the panels 16. In FIG. 2, five of the faces will be apparent and are numbered 32, 34, 36, 38 and 40. The faces 32, 34, 36, 38 and 40 as well as the non-illustrated faces are the faces of a regular, truncated polyhedron. As a consequence, they slant downwardly and outwardly so as to mount the panels 16 in a spreading configuration as is apparent from FIG. 1.

Each of the faces, as shown by the faces 34, 36 and 38, includes a fastener receiving bore 42. Typically, the bore 42 will be threaded as is apparent in FIG. 3 for receipt of a threaded fastener. As can be seen in FIG. 3, each bore 42 is transverse to the plane of the associated face.

Each threaded fastener has an enlarged head 28 as mentioned previously. This may take on any desired configuration but not uncommonly, the same will be in the form of a brass sphere. A threaded rod 44 may be threaded into a threaded bore (not shown) in the head 28 to provide the configuration illustrated in FIG. 3. Alternatively, the threaded rod 44 could be threaded into the bore 42 for subsequent receipt of the head 28.

In either event, the upper narrow end 24 of each of the panels 16 is provided with a hole 46 which is oriented so as to be alignable with the bore 42 on an associated face of the base 20 to orient the panel 16 in the desired location thereon. The threaded fastener is then utilized to secure the corresponding panel 16 in place on the base 10. In this connection, a cushion or pad 48 may be interposed between the panel 16 and the corresponding face of the base 10. To aid in assembly, one side of the cushion 48 may be provided with adhesive (not shown) whereby the same may be adhered to a desired one of the faces on the base 10. Preferably, the cushion 48 is made of a plastic material so as to provide some degree of resilience when the panel 16 is clamped thereagainst by the fastener 28. Vinyl is an excellent material to use in that it engages glass, the material of which the panels 16 are typically formed, with a sufficient degree of friction as to prevent the panels 16 from pivoting about their point of securement to the base 10 defined by the threaded fasteners 44. Where the decorative plates 30 are employed, they too are provided with an opening 50 alignable with the opening 46 in the corresponding panel 16 and mounted to the base 10 by the fastener 44.

To assist in positioning, the decorative plates 30 are typically provided with opposed, inwardly directed sides 52 (only one of which is shown) which flank the edges 20 and 22 of the corresponding panel 16 near the end 24.

In a preferred embodiment, the base 10 is formed of a casting and may be painted with an appropriate metallic paint. Alternatively, however, the base 10 could be formed by stamping from sheet metal or the like. Typically, the lower edge 54 of each of the faces will be made somewhat concave. As seen in FIG. 3, centrally of the base 10, the same is provided with an aperture 56 for receipt of an electrical socket 58 having a threaded exterior 60. The socket 58 receives a bulb 62 and the presence of the concave sides 54 allows more light from the bulb 62 to reach the panels 16.

Upper and lower nuts 64 and 66 disposed about the base 10 and threaded on the threaded exterior 60 of the socket 58 hold the latter in place. However, it will be recognized that a large variety of differing mounting schemes could be used to mount the socket 58 to the base 60.

A modified embodiment of the invention is illustrated in FIGS. 4 and 5. In this embodiment of the invention, the base 10 is modified so as to provide means whereby an object may be suspended from the lamp. As seen in FIG. 4, the object may be in the form of a planter 70 suspended by chains 72 arranged in a triangular configuration. The upper ends of the chains 72 are secured to the base 10 by hook-like elements 74 (only one of which is shown). As seen in FIG. 4, in section, the center of the base 10 is recessed as at 76 and the hook-like element 74 includes an upturned portion 78 to provide a recess 80 in which a part 82 of a chain link may be nestably received. As seen in FIG. 5, the hook-like element 74 is surrounded by a C-shaped aperture 84 of sufficient size to allow the chain link 82 to pass by the free end 86 of the hook-like element 74 to be passed about the same. As can also be seen in FIGS. 4 and 5, the free end 86 of the hook-like element is provided with a threaded bore 88 which is aligned with the bore 42 and adjacent face 32. In the usual case, the bore 88 may just be a continuation of the bore 42.

In any event, with the chain link 82 in the location illustrated in FIG. 4, subsequent passing of a threaded fastener 44 into the bore 42 and the bore 88 will positively capture such link on the hook-like element 74 to prevent inadvertent disassembly.

Typically, when this modification is used, the number of the faces on the base 10 will be a multiple of the number of chains 72 utilized to support the planter 70 or other object. For example, if the planter 70 is being supported by three chains, six or nine faces will be provided on the base 10.

Still another embodiment of the invention is illustrated in FIGS. 6 and 7. The same includes a base which preferably is cast but may be manufactured in other fashions. The same is thin and includes a first plurality of faces 112, 114, 116, 118 and 120. The faces 112, 114, 116, 118 and 120 are equally angularly spaced around the periphery of the base 110 and in fact are the faces of a truncated, regular polyhedron. These faces correspond approximately to the faces shown on the base 10 with the exception that they are fewer in number.

Each of the faces 112, 114, 116, 118 and 120 is planar and is in effect the bottom of a groove. That is to say the sides of each of such faces are defined by outwardly extending sides 122 and 124 which are adapted to embrace the upper ends of the edges 20 and 22 of a panel 16. Thus, the sides 122 and 124 serve to locate a panel 16 such that the opening 46 (FIG. 3) therein is alignable with a threaded bore 126 corresponding to the threaded bores 42.

As can be seen in FIG. 6, the adjacent sides 122 and 124 of each of two adjacent faces as, for example, the faces 116 and 118 define a further face 130. Given the fact that five of the faces in the embodiment illustrated in FIG. 6 and the presence of five of the sides 122 and 124, it follows that there will be five of such additional faces. In addition to that shown at 130, additional faces are shown at 132, 134, 136 and 138. Each of the additional faces is provided with a fastener receiving bore 140 for receipt of a fastener to secure an additional panel 16 thereto. Typically, the bores 140 will be threaded for receipt of threaded fasteners as described previously herein.

The faces 130, 132, 134 and 136 and 138 are all equidistant from the center of the base 110 as are the faces 112, 114, 116, 118 and 120. However, the former set of faces is at a greater distance from such center than the latter set of such faces. The faces 130, 132, 134, 136, 138 are equally angularly spaced around the periphery of the base 110 and have the same angular relation with respect to a plane passing therethrough as the faces 112, 114, 116, 118 and 120.

As a consequence of this construction, a greater number of the panels 16 may be affixed to the base 110 such as illustrated in FIG. 7. In this embodiment, the panels 16 affixed to the faces 130, 132, 134, 136 and 138 are designated 16' whereas the panels affixed to the faces 112, 114, 116, 118', and 120 are designated 16 as previously. It will be appreciated that the panels 16' overlap the junction between two adjacent ones of the panels 16. that is to say, whereas the embodiment illustrated in FIG. 1 has slight gaps between the edges 20 and 22 of adjacent panels 16, such gaps are covered by the panels 16' in the embodiment illustrated in FIGS. 6 and 7.

As alluded previously, a lamp made according to the invention minimizes storage and/or packaging requirements. In particular, the panels 16 and 16' may be stored in side-by-side relation providing only a thin layer of cushioning between each panel to prevent breakage during handling or shipping. Thus, a stack of, for example, eight of planar panels with interposed packing may have a thickness of only a couple of inches. If, given a length of eleven or twelve inches, and a maximum width of between four and a half or five inches at the wide ends, the same may be readily packaged with adequate protection in a container having a dimension of approximately 3"×10"×13".

Yet, the same lamp when assembled, if packaged with adequate protection would require a container having a dimension of a least 12"×15"×15".

As a consequence, by utilization of the invention, storage and/or shelf requirements for a given lamp are cut to a minor fraction of that heretofore required. At the same time, the lamps may be readily assembled without the use of tools since the nuts 64 and 66 are readily hand tightened to secure the socket 58 to the base 10 and the heads 28 on the threaded fasteners are preferably made of sufficient size as to readily enable hand tightening of the threaded fasteners with the panels 16 in place.

We claim:

1. A lamp capable of storage in a relatively small space while disassembled and easy rapid assembly comprising:

a thin base having a plurality of "n" slanted faces defining side faces of a regular, truncated polyhedron;

a threaded bore in each of said faces;

a plurality of "n" thin, planar, light transmitting panels each adapted to bear decorative indicia and each having elongated, converging, opposed sides interconnected by a narrow end and a wide end;

a hole in each of said panels adjacent said narrow end;

a plurality of "n" threaded fasteners, each having a large head of sufficient size as to be easily rotatable by a human hand, each of said fasteners extending through the hole of an associated panel and into the bore of an associated one of said faces to mount the associated panel thereon so that the sides thereof are relatively close to the adjacent sides of adjacent panels; and means for mounting an electrical socket to said base such that the socket opens toward the wide ends of said panels.

2. The lamp of claim 1 wherein said base is a casting.

3. The lamp of claim 1 further including a cushioning pad interposed between each of said panels and the associated face.

4. The lamp of claim 1 wherein said large heads further have a decorative exterior.

5. The lamp of claim 1 wherein each of said slanted faces is equidistant from the center of said base and further including a plurality of "n" additional faces, said additional faces being equidistant from said center and spaced therefrom a distance greater than the spacing of said slanted faces, said additional faces and said slanted faces being located in alternating fashion about said base and each having a threaded bore, and additional ones of said panels secured by additional ones of said threaded fasteners to associated ones of said additional panels.

6. The lamp of claim 1 further including at least one hook shaped element formed in said base inwardly of said faces and adapted to receive a suspending device for suspending an object to hang from said lamp.

7. The lamp of claim 6 wherein said element has a free end provided with a threaded bore aligned with the threaded bore in the adjacent face so that one of said threaded fasteners may enter said free end and capture a suspending device on said element.

8. A lamp capable of storage in a relatively small space while disassembled and easy rapid assembly comprising:

a thin base having a plurality of "n" slanted faces defining side faces of a regular, truncated polyhedron;

a fastener receiving bore in each of said faces;

a plurality of "n" glass panels each adapted to bear decorative indicia and each having elongated opposed sides converging to define an end;

a hole in each of said panels adjacent said end;

a plurality of "n" fasteners, each having a decorative head extending through the hole of an associated panel and into the bore of an associated one of said faces to mount the associated panel thereon so that the sides thereof are relatively close to the adjacent sides of adjacent panels with said heads being exposed for aesthetic purposes; and means for mounting an electrical socket to said base such that the socket opens toward the wide ends of said panels.

9. The lamp of claim 8 wherein said base is plate-like and said faces are equally angularly spaced about the periphery thereof, each said face being bounded by sides extending outwardly of the face and adapted to abut and position corresponding sides of the associated panel.

10. The lamp of claim 9 wherein the adjacent sides of each of two adjacent faces each terminate in a further face; each said further face being adapted to mount a further panel, each further panel overlapping the junction of a pair of adjacent panels.

* * * * *